US007721916B2

(12) United States Patent
Szekely

(10) Patent No.: US 7,721,916 B2
(45) Date of Patent: May 25, 2010

(54) POUR SPOUT

(75) Inventor: Alex S. Szekely, Jackson, NJ (US)

(73) Assignee: Plastek Industries, Inc., Erie, PA (US)

( * ) Notice: Subject to any disclaimer, the term of this patent is extended or adjusted under 35 U.S.C. 154(b) by 1014 days.

(21) Appl. No.: 11/424,463

(22) Filed: Jun. 15, 2006

(65) Prior Publication Data

US 2009/0223962 A1 Sep. 10, 2009

Related U.S. Application Data

(60) Provisional application No. 60/691,185, filed on Jun. 15, 2005.

(51) Int. Cl.
*B67D 1/16* (2006.01)

(52) U.S. Cl. ..... 222/109; 222/110; 222/111; 222/520

(58) Field of Classification Search ..... 222/182, 222/507, 521, 568, 108–111, 519–520
See application file for complete search history.

(56) References Cited

U.S. PATENT DOCUMENTS 174,840 A * 3/1876 Newton ..... 222/110
256,586 A * 4/1882 Newton ..... 222/110
2,729,364 A * 1/1956 Malko ..... 222/211
3,184,782 A * 5/1965 Armour ..... 401/262
3,369,710 A * 2/1968 Lucas ..... 222/109
3,424,355 A * 1/1969 Blumen ..... 222/450
4,836,419 A * 6/1989 Metz et al. ..... 222/110
5,020,699 A * 6/1991 Sams ..... 222/450
5,960,992 A * 10/1999 Bernstein et al. ..... 222/83.5
7,036,683 B2 * 5/2006 Dubach ..... 222/83
7,097,076 B1 * 8/2006 Giblin et al. ..... 222/109
7,458,486 B2 * 12/2008 Weist et al. ..... 222/83
7,540,405 B2 * 6/2009 Sase et al. ..... 229/125.14

* cited by examiner

*Primary Examiner*—Kevin P Shaver
*Assistant Examiner*—Robert K Nichols, II
(74) *Attorney, Agent, or Firm*—Bachman & LaPointe, P.C.

(57) ABSTRACT

A container has a body with a body opening. A spout fitment base is positioned within the body opening. A spout has a threaded engagement with the spout fitment base for movement between a retracted position and an extended position. A cap has a removed condition disengaged from the body, spout fitment base, and spout. The cap has an installed condition having a threaded engagement with at least one of the body and spout base fitment. An unscrewing of the cap from its installed condition rotates the spout so that the threaded engagement with the spout with the spout base fitment drive the spout from the retracted condition toward the extended condition.

20 Claims, 9 Drawing Sheets

POUR SPOUT

CROSS-REFERENCE TO RELATED APPLICATIONS

Benefit is claimed of U.S. patent application Ser. No. 60/691,185, filed Jun. 15, 2005, and entitled "Dispensing Systems" the disclosure of which is incorporated by reference herein as if set forth at length.

BACKGROUND OF THE INVENTION

The invention relates to containers. More particularly, the invention relates to pour spouts for containers for liquid laundry detergent and the like.

There has been an evolution in the configuration of containers for liquid laundry detergent, fabric softener, and the like. The dominant form of container is a wide mouth bottle having an attached spout with a drain-back trough and aperture. In a typical group of container configurations and their methods of assembly, a bottle, spout fitment, and cap are individually molded (e.g., of high density polyethylene (HDPE)). Exemplary bottle molding is via roto-molding whereas exemplary spout fitment and cap molding are by injection molding. An exemplary spout fitment includes the spout and a continuation of the spout defining the base and outboard wall of the trough. The fitment further typically includes a flange (e.g., extending outward at an upper end of the outboard extremity of the trough).

The spout fitment may be inserted through a mouth of the bottle (e.g., so that an outer surface of the outboard trough wall whereof another wall outboard thereof engages the inner surface of the bottle neck). The spout fitment may be secured and sealed to the bottle such as by spin welding. The bottle may be filled and the cap may be installed. Exemplary caps typically have either an externally threaded skirt for engaging an internally threaded portion of the fitment or an internally threaded skirt for engaging an externally threaded portion of the fitment or bottle neck. With a typical externally threaded skirt, the cap includes an outwardly projecting flange above the skirt. Upon installation of the cap to the fitment, the flange underside contacts and seals with the fitment flange upper surface to seal the bottle.

Various examples of bottles are shown in U.S. Pat. Nos. 6,923,341, 5,941,422, 5,566,862, and 5,603,787.

SUMMARY OF THE INVENTION

One aspect of the invention is a container having a body with a body opening. A spout fitment base is positioned within the body opening. A spout has a threaded engagement with the spout fitment base for movement between a retracted position and an extended position. A cap has a removed condition disengaged from the body, spout fitment base, and spout. The cap has an installed condition having a threaded engagement with at least one of the body and spout base fitment. An unscrewing of the cap from its installed condition rotates the spout so that the threaded engagement with the spout with the spout base fitment drive the spout from the retracted condition toward the extended condition.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements. Various drawings may show artifacts of generation from a solid model.

DETAILED DESCRIPTION

Figure 1:
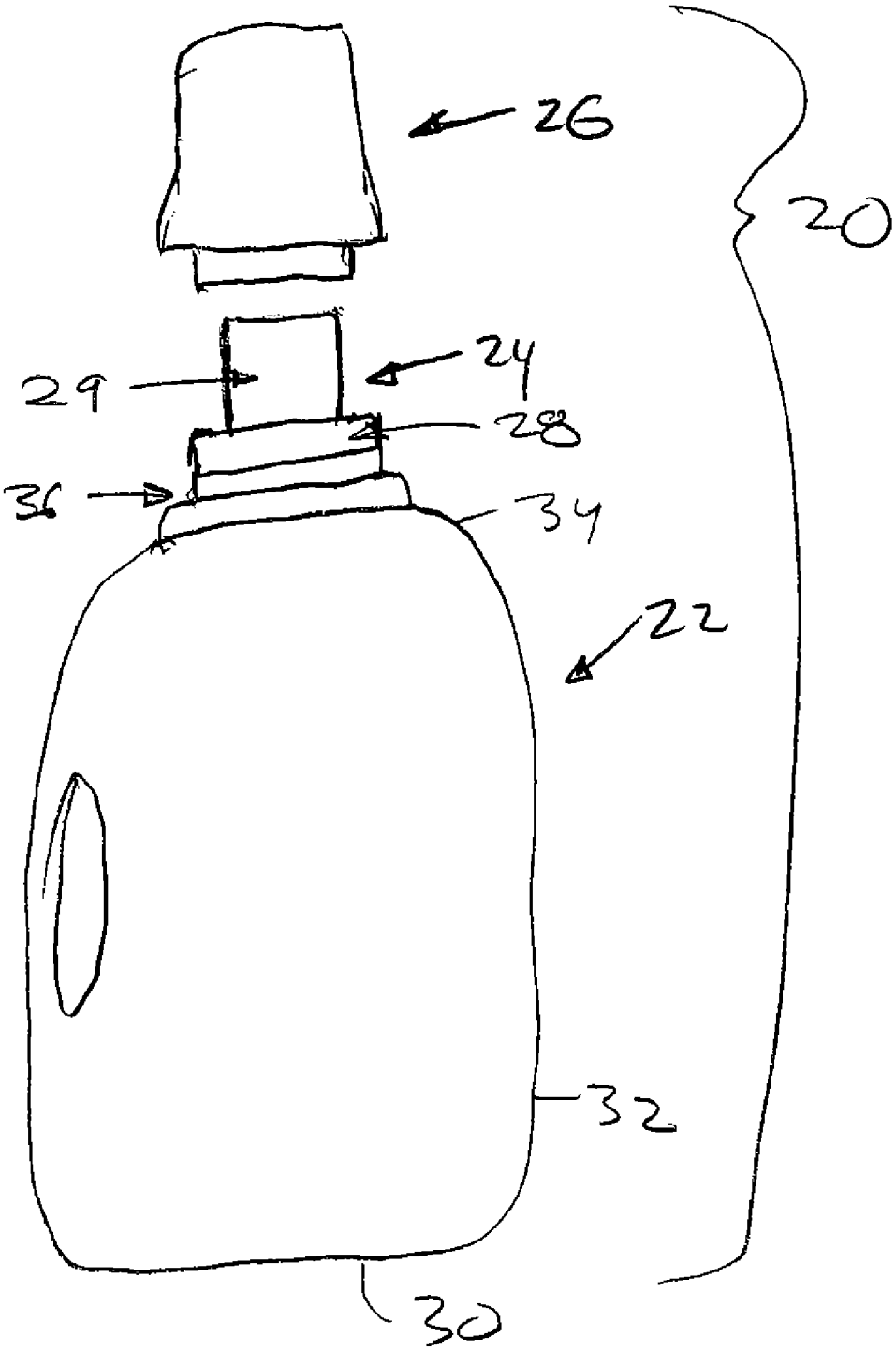
FIG. 1 is a view of a bottle.
Figure 2:
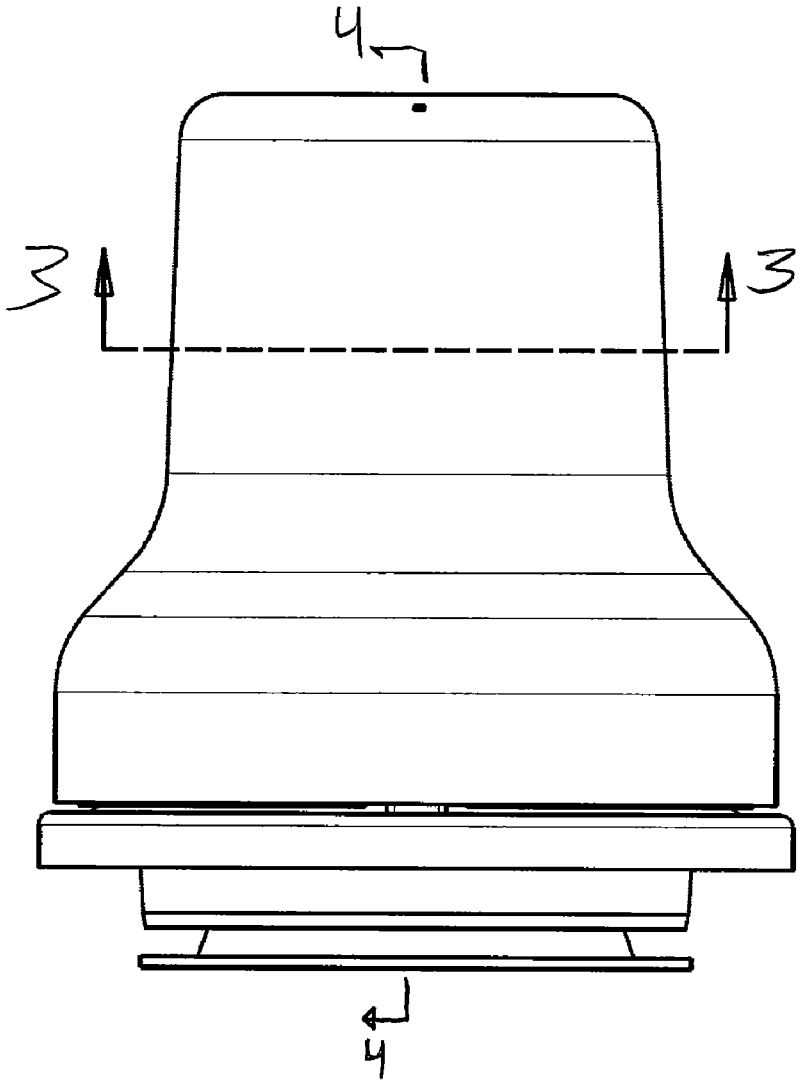
FIG. 2 is a side view of a cap, spout fitment, and body neck of the bottle of FIG. 1.
Figure 3:
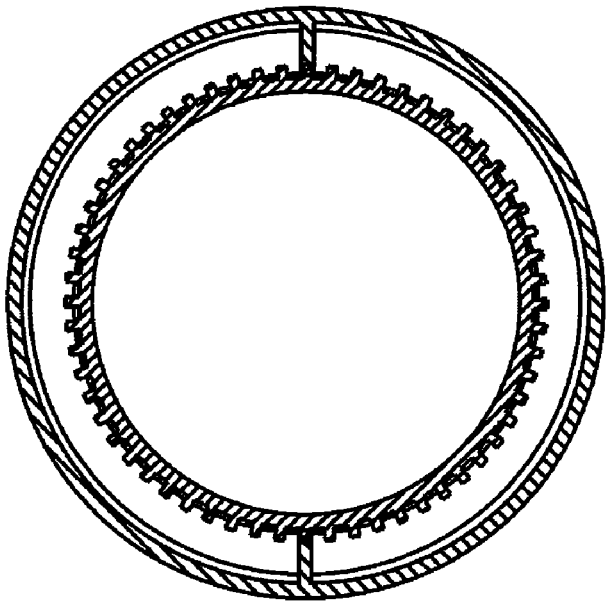
FIG. 3 is an upward sectional view of the bottle of FIG. 2, taken along line 3-3.
Figure 4:
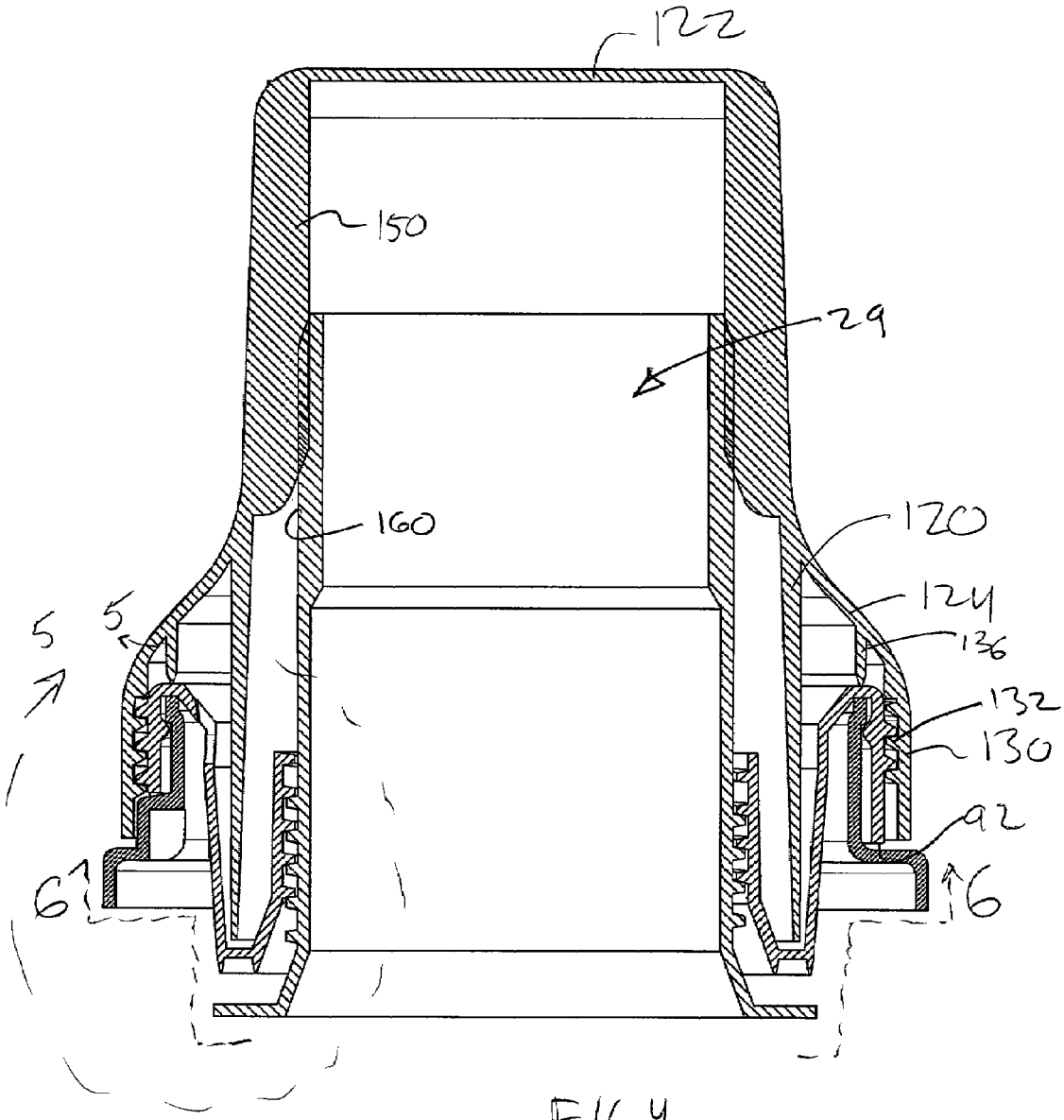
FIG. 4 is a vertical sectional view of the bottle of FIG. 2, taken along line 4-4.

FIG. 1 shows a container 20 comprising the assembly of a bottle body 22, a spout fitment 24, and a cap 26 (which may serve as a measuring/dispensing cup). The body and cap may be made as a unitary plastic molding. As is discussed further below, the exemplary spout fitment comprises two molded pieces: a spout base fitment 28 and a spout 29. Exemplary bottle body material is high density polyethylene (HDPE). Exemplary spout fitment and cap material is polypropylene.

Figure 8:
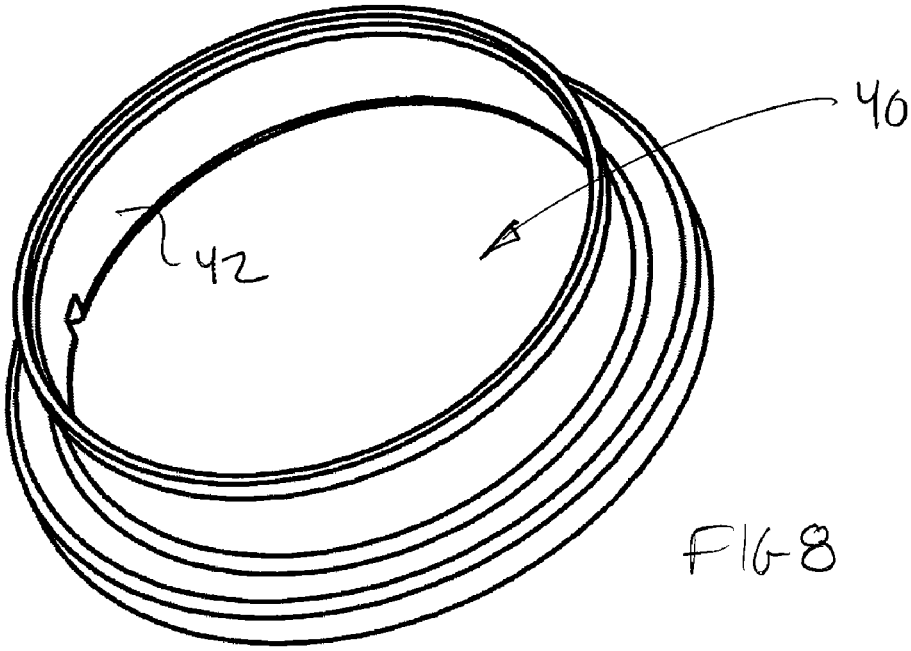
FIG. 8 is a view of the neck region of FIG. 7.
Figure 7:
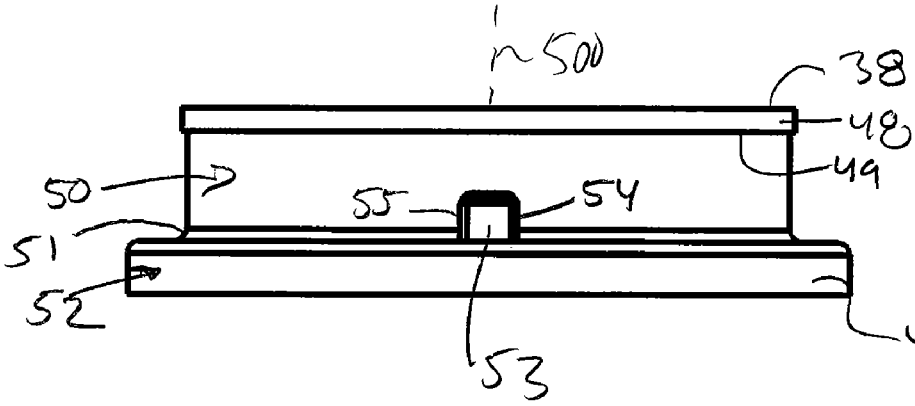
FIG. 7 is a side view of the neck region of the bottle of FIG. 1.

The body 22 comprises a unitary combination of a base 30, a sidewall 32 extending upward from the base, a shoulder 34 at an upper end of the sidewall, and a neck 36 extending upward from the shoulder. The neck 36 extends to a rim 38 (FIGS. 7 and 8) and defines an opening 40 having a central longitudinal axis 500. The bottle body has an interior surface 42 and an exterior surface 44. A handle 46 (FIG. 1) may extend from the sidewall and the body interior may extend through the handle.

The neck 36 (FIGS. 7 and 8) has an outwardly-projecting annular flange 48 at the rim 38. The flange 48 has an underside 49. A narrow region 50 extends downward below the flange 48 to a shoulder junction 51 with a wider region 52. A lug 53 extends upward from the junction 51 partially along the region 50 and has first and second circumferential ends/faces/surfaces 54 and 55. As is discussed below, the flange 48 helps retain the spout base fitment to the neck while the lug 53 helps angularly orient the spout base fitment about the axis 500.

Figure 9:
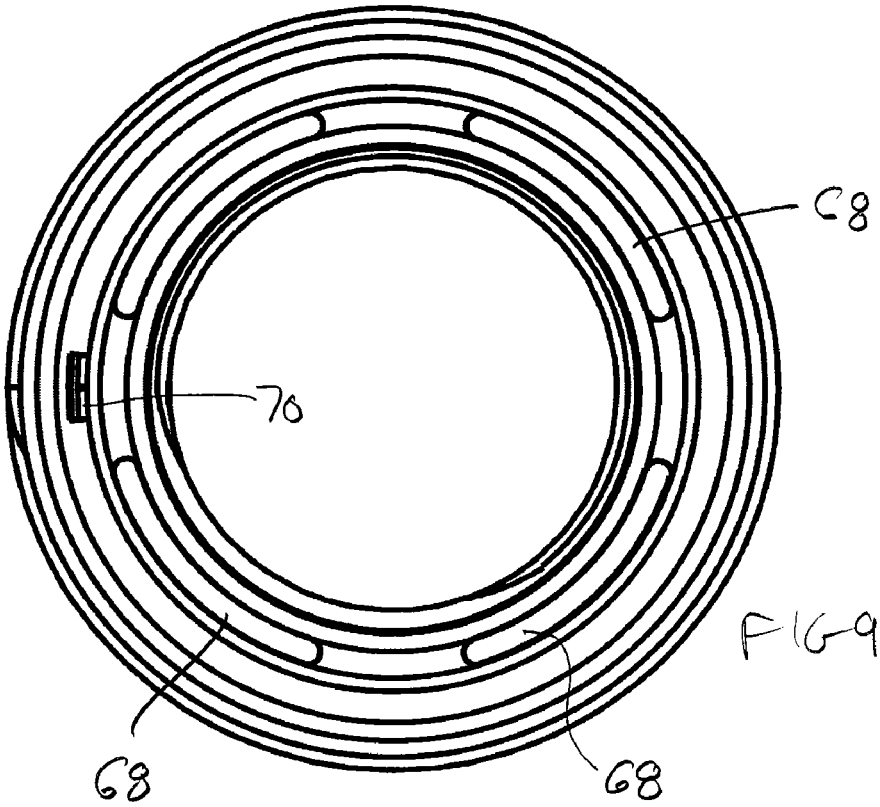
FIG. 9 is a top view of a spout base fitment of the bottle of FIG. 1.

The spout base fitment 28 (FIGS. 4, 5, 9, and 10) includes an inner wall 60 and an inner sidewall 62 joined by a lower wall 64 so as to define a trough 66. One or more drain-back apertures 68 (FIG. 9) along the trough base and/or vents 70 thereabove are open to the trough (e.g., through the wall 64 and sidewall 62, respectively). The inner wall 60 has an upper end 72 defining an opening 74. An internal thread 76 is formed on the inner surface of the inner wall 60. Inboard and outboard annular v-land seal teeth 78 and 79 depend from the lower wall 64. The exemplary teeth 78 and 79 are full annuli, positioned respectively inboard and outboard of the apertures 68.

Figure 10:
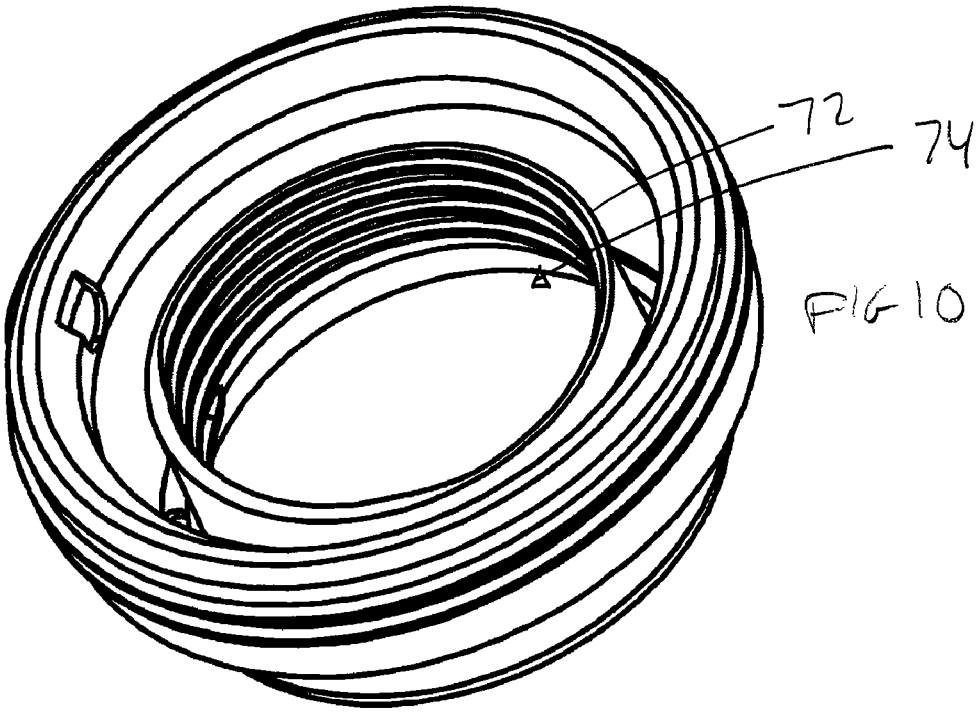
FIG. 10 is a view of the spout fitment of FIG. 9.
Figure 12:
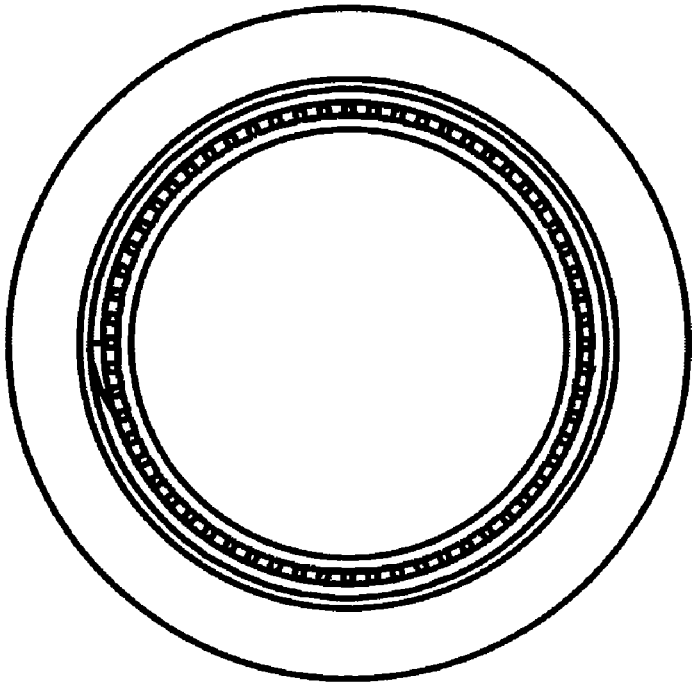
FIG. 12 is a top view of the spout of FIG. 11.

FIG. 10 shows the spout base fitment sidewall 62 having an upper end 80. A flange 82 extends outward from the upper end 80. The flange 82 has an upper surface 84. An outer sidewall 90 depends from an upper edge at an outboard periphery of the flange 82 to a lower end/rim 92. The outer sidewall 90 has an inboard surface and an outboard surface. A recess 94 extends upward from the rim 92 and has first and second sides. As is discussed further below, the recess 94 captures the neck lug 53 so that adjacent surfaces of the recess and neck lug angularly retain the spout base fitment relative to the neck.

The inboard surface of the outer sidewall 90 bears an annular projection 100. As is discussed below, whereas the recess 94 functions to orient the spout base fitment on the body, the projection 100 cooperates with the projection 48 to provide a snap fit engagement retaining the spout base fitment to the body. The outboard surface of the outer sidewall 90 bears an external thread 102. As is discussed further below, the external thread helps engage the cap to the spout base fitment.

Figure 5:
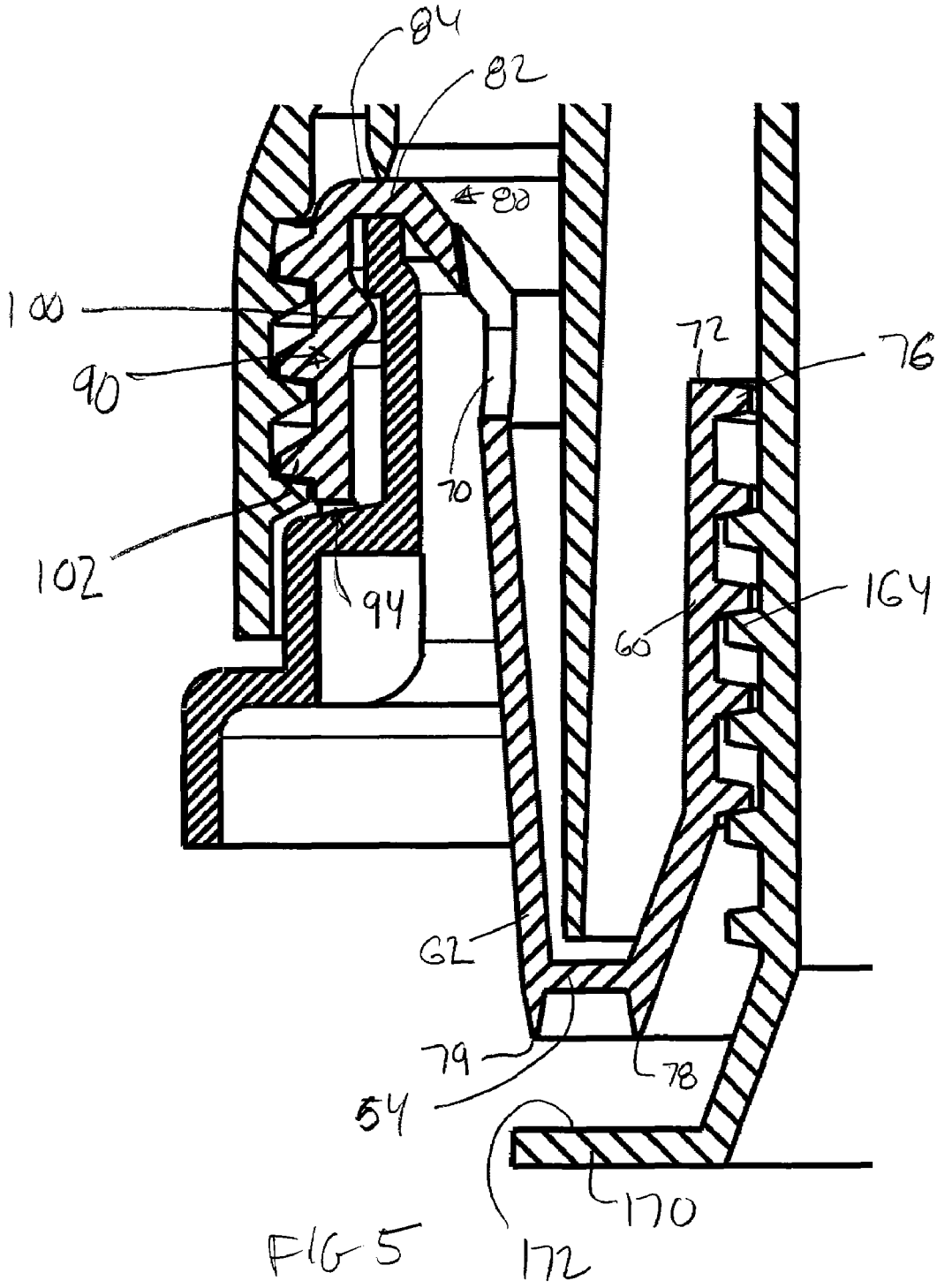
FIG. 5 is an enlarged view of a cap-spout fitment-neck junction of the bottle of FIG. 4.
Figure 6:
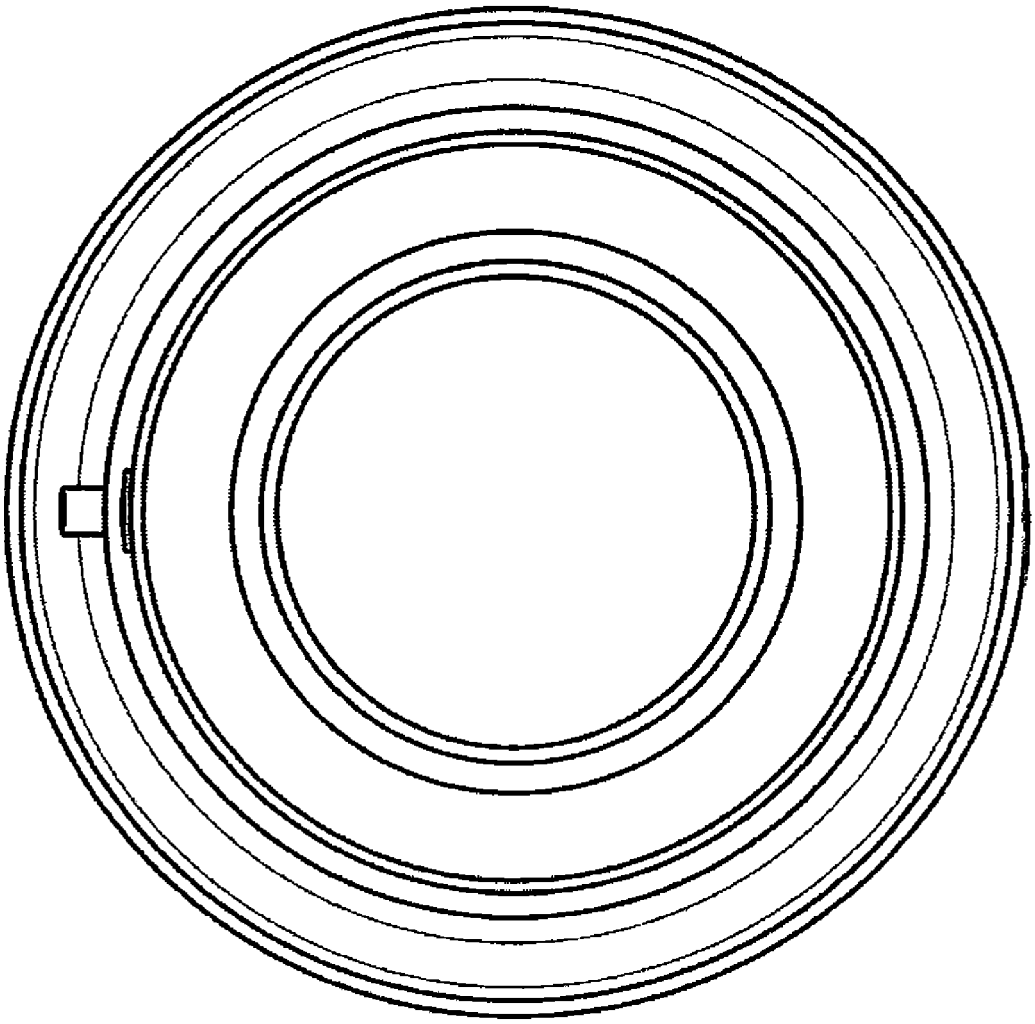
FIG. 6 is an upward sectional view of the bottle of FIG. 4, taken along line 6-6.
Figure 11:
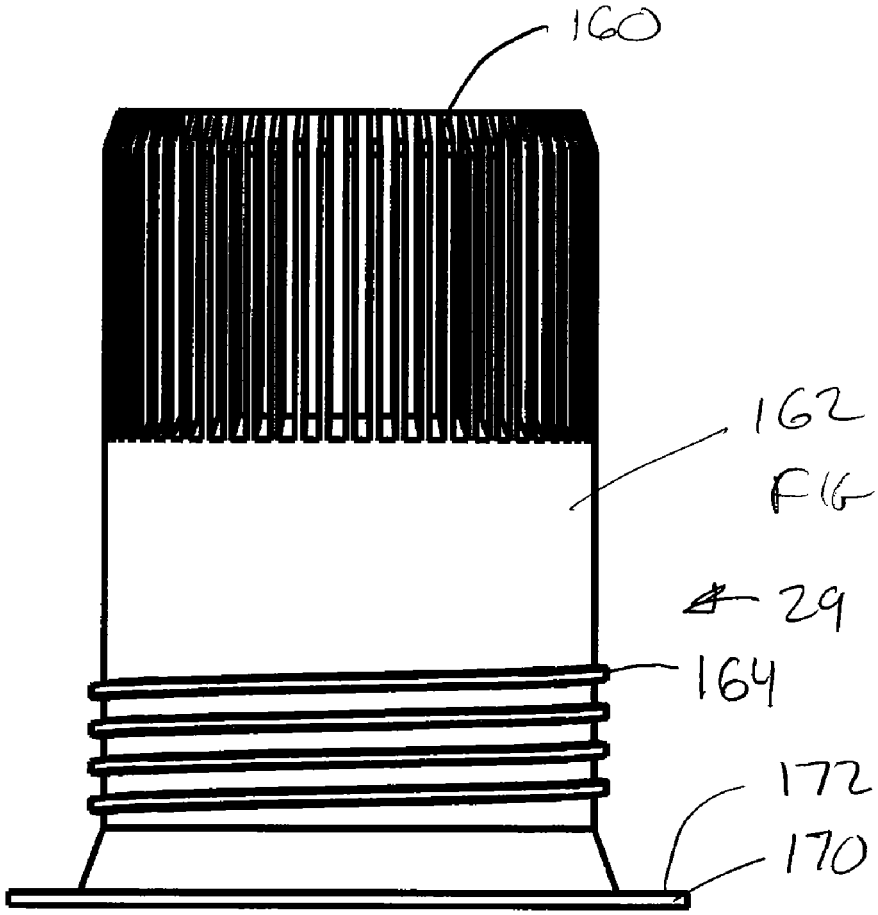
FIG. 11 is a side view of a spout of the bottle of FIG. 1.
Figure 13:
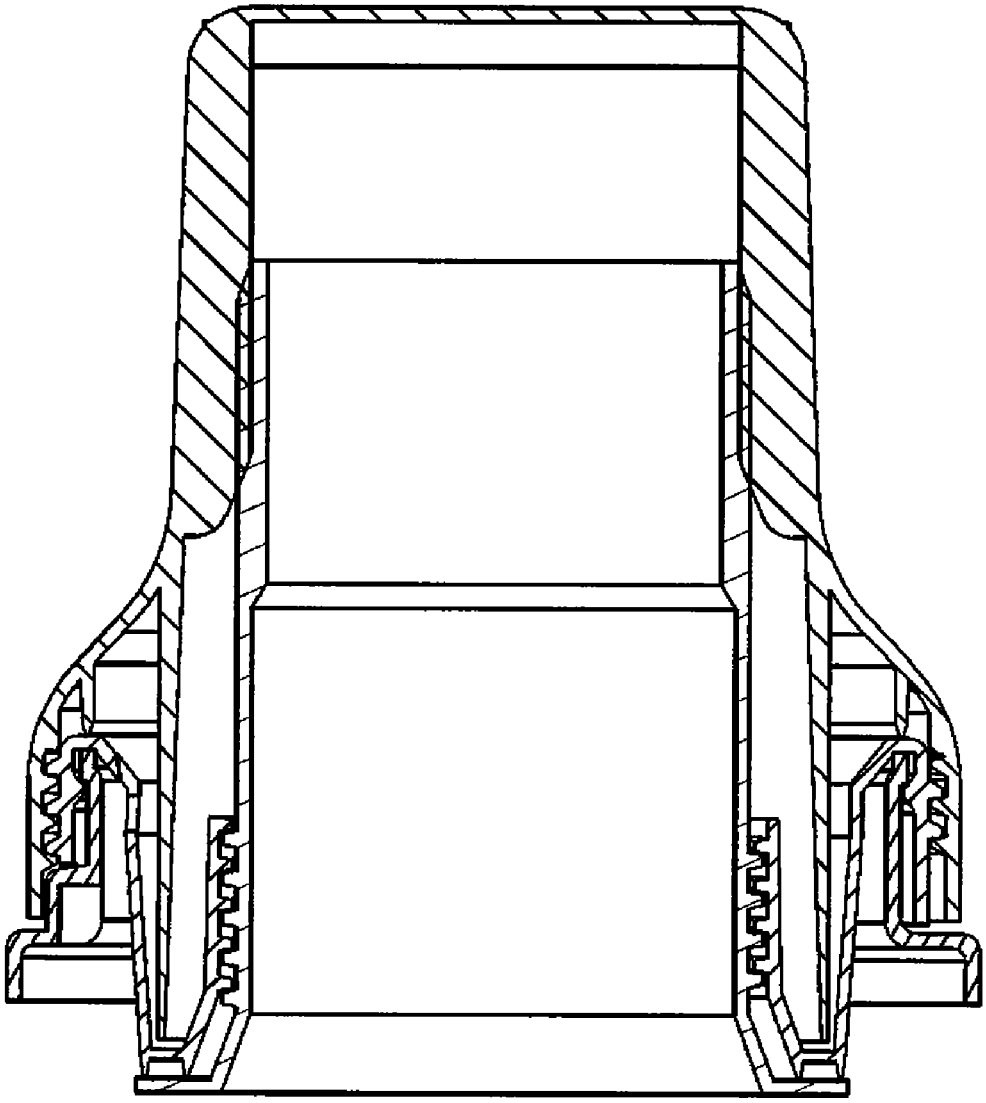
FIG. 13 is a vertical sectional view of the bottle with the spout shifted to an extended condition.

The cap 26 (FIG. 4) includes a sidewall 120, a transverse web 122 at the upper end of the sidewall, and an outwardly/downwardly projecting bell flange 124 spaced above a lower end 126 of the sidewall. A lower portion 130 of the bell flange 124 bears an internal thread 132 positioned for engaging the external thread 102. The bell flange 124 has a depending v-bead land seal 136 between the sidewall 120 and lower portion 130. The seal 136 is positioned so that its rim contacts and seals with the flange upper surface 84 of the spout base fitment when the cap is screwed on to the spout base fitment. Along an upper portion of the sidewall 120, a pair of splines 150 extend inward. As is discussed below, the splines 150 engage splines 160 of the spout 29. FIG. 11 shows the splines 160 along an upper portion of a wall 162 of the spout 29. Below the splines, the wall bears an external thread 164. As is shown in FIG. 5, the thread 164 engages the spout base fitment internal threads 76. A flange 170 extends outward from a lower end of the wall 62 and has an upper surface 172. FIG. 5 shows a retracted spout condition wherein the upper surface 172 is spaced below the rims of the v-bead land seals 78 and 79. In this condition, the drainback apertures are open permitting the trough to drain. Due to the engagement of the threads 76 and 164, a relative rotation of the spout and spout base fitment will cause a relative translation along the axis 500. For example, relative rotation in one direction can raise the spout so that the flange upper surface 172 comes into sealing engagement with the v-bead land seals 78 and 79, thereby blocking the drainback apertures. Such a condition may be useful for pouring. The blocking of the drainback apertures during pouring is advantageous to avoid leakage. If the bottle is tilted too much during pouring, the liquid (e.g., detergent) may otherwise flow through the drainback apertures, into the trough, and ultimately, potentially, down the side of the bottle, creating a mess. Blocking of the drainback apertures during pouring avoids this.

In the exemplary bottle, the screwing and unscrewing rotation of the cap is used to retract and extend the spout. The spout may initially be envisioned in an extended condition with the cap removed from the spout base fitment. The cap may be installed to the spout and spout base fitment. In an initial insertion installation, the cap and spout splines engage. Then, the cap and spout base fitment threads contact each other stopping further pure translation. At this point, the cap may be rotated to screw the cap onto the spout base fitment. During this rotation, the cooperation of the cap and spout splines causes the spout to rotate with the cap. Rotation of the spout causes a screwing of the thread 164 further down into the thread 76, disengaging the upper surface 172 of the flange 170 from the v-bead land seals 78 and 79. Eventually, the cap will bottom with the v-bead land seal 136 contacting the spout base fitment flange upper surface 84 to seal the bottle. Cap removal and spout extension is by a reverse of this process.

In an exemplary method of assembly, the cap is initially fully or partially screwed onto the spout base fitment. The cap and spout fitment subassembly may be installed to the body neck by a linear insertion. During the insertion, the lug 53 is aligned with the recess 94. An initial stage of the insertion may produce a camming action between the projections 48 and 100. Further insertion causes the recess to receive the lug and the projection 100 to snap over the projection 48 and at least partially relax. Advantageously, the relaxation is only partial, sufficient to provide a mechanical backlocking to resist spout fitment extraction yet leaving stress/strain sufficient to maintain a sealing engagement between the spout fitment and neck. Advantageously, this sealing engagement remains when the cap is unscrewed. Thus, the dimensions of the spout fitment and neck are advantageously such that, in the absence of the cap, their interference contact is sufficient to provide sealing under normal loads associated with pouring, transport, and handling. Other spout fitment-to-neck engagements and other cap-to-spout fitment engagements are disclosed in the above-identified provisional application. These or other yet-developed or prior art engagements may be used with the inventive telescoping spout.

Various implementations may have one or more of other various advantages. One group of advantages relate to elimination of welding or adhering of the spout fitment to the bottle body. In addition to the economy of a saved step, this may facilitate delivery of the liquid before attaching the spout fitment to the bottle body which may allow more efficient processing (e.g., including higher flow delivery or less precisely aimed delivery through an opening in the bottle body larger than the spout opening). The spout fitments and caps may be delivered to the bottler as units and installed in units, thereby easing installation. Other potential advantages include weight reduction and reduced intrusion of the spout fitment into the bottle body (thereby permitting higher fill levels). Other potential advantages include improved sealing. Finally, there may be greater flexibility in aesthetics by permitting relatively easy use of differently-styled spout fitments with a given bottle body or differently styled bottle bodies with a given spout fitment.

One or more embodiments of the present invention have been described. Nevertheless, it will be understood that various modifications may be made without departing from the spirit and scope of the invention. For example, when implemented in the reengineering of an existing container configuration, details of the existing configuration may influence or dictate details of any particular implementation. Accordingly, other embodiments are within the scope of the following claims.

What is claimed is:

1. A container comprising:

a body having a body opening;

a spout base fitment within the body opening;

a spout having a threaded engagement with the spout base fitment for movement between a retracted position and an extended position; and a cap having:

a removed condition disengaged from the body, spout base fitment, and spout; and an installed condition having a threaded engagement with at least one of the body and spout base fitment so that:

an unscrewing of the cap from its installed condition rotates the spout so that the threaded engagement of the spout with the spout base fitment raises the spout to drive the spout from the retracted condition toward the extended condition.

2. A container comprising:

a body having a body opening;

a spout base fitment within the body opening;

a spout having a threaded engagement with the spout base fitment for movement between a retracted position and an extended position; and a cap having:

a removed condition disengaged from the body, spout base fitment, and spout; and an installed condition having a threaded engagement with at least one of the body and spout base fitment so that:

an unscrewing of the cap from its installed condition rotates the spout so that the threaded engagement of the spout with the spout base fitment drives the spout from the retracted condition toward the extended condition, and wherein:

the spout base fitment defines a drain-back trough having a drain-back port; and in the extended position, the spout blocks said drain-back port.

3. The container of claim 1 wherein:

the spout has a proximal end flange;

the spout base fitment defines a drain-back trough having a drain-back port; and in the extended position, the proximal end flange blocks said drain-back port.

4. A container comprising:

a body having a body opening;

a spout base fitment within the body opening;

a spout having a threaded engagement with the spout base fitment for movement between a retracted position and an extended position; and a cap having:

a removed condition disengaged from the body, spout base fitment, and spout; and an installed condition having a threaded engagement with at least one of the body and spout base fitment so that:

an unscrewing of the cap from its installed condition rotates the spout so that the threaded engagement of the spout with the spout base fitment raises the spout to drive the spout from the retracted condition toward the extended condition, and wherein:

a screwing of the cap to its installed condition rotates the spout so that the threaded engagement of the spout with the spout base fitment drives the spout from the extended condition toward the retracted condition.

5. The container of claim 1 further comprising:

means on the body and spout base fitment for preventing relative rotation of the body and fitment about a central longitudinal axis of the opening.

6. A container comprising:

a body having a body opening;

a spout base fitment within the body opening;

a spout having a threaded engagement with the spout base fitment for movement between a retracted position and an extended position; and a cap having:

a removed condition disengaged from the body, spout base fitment, and spout and an installed condition having a threaded engagement with at least one of the body and spout base fitment so that:

an unscrewing of the cap from its installed condition rotates the spout so that the threaded engagement of the spout with the spout base fitment drives the spout from the retracted condition toward the extended condition, and wherein:

the spout has a plurality of external splines; and the cap has a plurality of internal splines, positioned to engage the plurality of external splines during at least a portion of the unscrewing to drive rotation of the spout.

7. The container of claim 1 wherein:

the spout has at least one first surface; and the cap has at least one second surface, positioned to engage the at least one first surface during at least a portion of the unscrewing to drive rotation of the spout.

8. The container of claim 1 wherein:

a portion of the cap is internally threaded to threadingly engage an externally threaded portion of the spout base fitment.

9. The container of claim 1 wherein:

the body consists essentially of HDPE;

the spout consists essentially of polypropylene; and the spout base fitment consists essentially of polypropylene; and the cap consists essentially of polypropylene.

10. The container of claim 1 wherein:

the body has an integrally molded handle; and an interior compartment of the body extends through the handle.

11. The container of claim 1 wherein:

the spout base fitment is neither adhered nor welded to the body.

12. The container of claim 1 wherein:

the fitment is not threadingly engaged to the body.

13. The container of claim 1 further comprising:

1.0-6.0 liters of a liquid within the body.

14. The container of claim 1 further comprising:

at least 1.0 liter of liquid detergent or fabric softener within the body.

15. A method for using a container, the container comprising:

a body having a body opening;

a spout base fitment within the body opening;

a spout having a threaded engagement with the spout base fitment for movement between a retracted position and an extended position; and a cap having:

a removed condition disengaged from the body, spout base fitment, and spout; and an installed condition having a threaded engagement with at least one of the body and spout base fitment so that:

an unscrewing of the cap from its installed condition rotates the spout so that the threaded engagement of the spout with the spout base fitment raises the spout to drive the spout from the retracted condition toward the extended condition, and the method comprising:

unscrewing the cap from its installed condition so as to rotate the spout so that the threaded engagement of the spout with the spout base fitment drives the spout from the retracted condition toward the extended condition;

pouring a liquid from the container through the spout;

rescrewing the cap to its installed condition so as to rotate the spout so that the threaded engagement of the spout with the spout base fitment drives the spout from the extended condition toward the retracted condition.

16. An assembly comprising:

a spout having:

sidewall;

an opening at first end of the sidewall; a plurality of external splines; and a first thread;

a spout base fitment having:

a second thread, engaged to the first thread through a range between first and second relative positions of the spout and spout base fitment;

a third thread; and a port, positioned to be blocked by the spout in the first relative position and clear in the second relative position; and a cap having:

a fourth thread engaged to the third thread; and a plurality of internal splines engaged to the plurality of external splines.

17. The assembly of claim 16 wherein:

the first thread is an external thread;

the second thread is an internal thread;

the spout has a flange at a second end; and the port is positioned to be blocked by the flange in the first relative position.

18. The assembly of claim 16 consisting essentially of the spout, spout base fitment, and cap, each consisting essentially of a single molding.

19. A method for using the assembly of claim 16, the method comprising:

unscrewing the cap from an installed condition, the unscrewing rotating the spout to drive the spout from the first relative position to the second relative position.

20. The method of claim 19 wherein:

the assembly further comprises a container body having a body opening in which the spout base fitment is mounted; and the method further comprises pouring liquid from the container body via the spout in the second relative position.

* * * * *